US008201642B2

(12) United States Patent
Radford et al.

(10) Patent No.: US 8,201,642 B2
(45) Date of Patent: Jun. 19, 2012

(54) DRILLING ASSEMBLIES INCLUDING ONE OF A COUNTER ROTATING DRILL BIT AND A COUNTER ROTATING REAMER, METHODS OF DRILLING, AND METHODS OF FORMING DRILLING ASSEMBLIES

(75) Inventors: Steven R. Radford, The Woodlands, TX (US); Matthew J. Meiners, Spring, TX (US); Sean K. Berzas, Tulsa, OK (US)

(73) Assignee: Baker Hughes Incorporated, Houston, TX (US)

( * ) Notice: Subject to any disclaimer, the term of this patent is extended or adjusted under 35 U.S.C. 154(b) by 313 days.

(21) Appl. No.: 12/542,351

(22) Filed: Aug. 17, 2009

(65) Prior Publication Data

US 2010/0181112 A1 Jul. 22, 2010

Related U.S. Application Data

(60) Provisional application No. 61/146,032, filed on Jan. 21, 2009.

(51) Int. Cl.
*E21B 11/00* (2006.01)

(52) U.S. Cl. ..... 175/262; 175/107

(58) Field of Classification Search ..... 175/262, 175/406, 385, 107
See application file for complete search history.

(56) References Cited

U.S. PATENT DOCUMENTS 3,055,443 A 9/1962 Edwards
3,367,430 A * 2/1968 Rowley ..... 175/385
4,059,165 A 11/1977 Clark
5,385,407 A 1/1995 De Lucia
5,472,057 A * 12/1995 Winfree ..... 175/57
5,518,379 A 5/1996 Harris et al.
5,568,838 A 10/1996 Struthers et al.
5,778,992 A 7/1998 Fuller
5,785,509 A 7/1998 Harris et al.

(Continued)

FOREIGN PATENT DOCUMENTS

EP 0770759 A2 5/1997

OTHER PUBLICATIONS

Written Opinion of the International Searching Authority for International Application No. PCT/US2010/021593 dated May 20, 2010, 4 pages.

(Continued)

*Primary Examiner* — Daniel P Stephenson
*Assistant Examiner* — Catherine Loikith
(74) *Attorney, Agent, or Firm* — TraskBritt

(57) ABSTRACT

Drilling assemblies include a drill bit and a reamer apparatus in which the drill bit is configured to rotate in rotational direction about a longitudinal axis of a drill string and the reamer apparatus is configured to rotate in an opposite rotational direction about the longitudinal axis. Methods of forming a drilling assembly include configuring a drill bit to drill a subterranean formation when rotating in a counter-clockwise direction and configuring a reamer apparatus to ream a wellbore within the subterranean formation when rotating in a clockwise direction. Methods of drilling wellbores in subterranean formations include rotating a drill bit in a first rotational direction about a longitudinal axis of a drill string to drill a wellbore and rotating a reamer apparatus in an opposite rotational direction about the longitudinal axis of the drill string to ream the wellbore.

21 Claims, 6 Drawing Sheets

U.S. PATENT DOCUMENTS

| | | | | |
|---|---|---|---|---|
| 6,142,228 | A | 11/2000 | Jogi et al. | |
| 6,378,626 | B1 | 4/2002 | Wallace | |
| 6,991,046 | B2 * | 1/2006 | Fielder et al. | 175/57 |
| 7,036,611 | B2 | 5/2006 | Radford et al. | |
| 7,334,650 | B2 * | 2/2008 | Giroux et al. | 175/26 |
| 7,413,032 | B2 | 8/2008 | Krueger | |
| 7,416,036 | B2 | 8/2008 | Forstner et al. | |
| 2006/0118298 | A1 | 6/2006 | Millar et al. | |
| 2006/0237234 | A1 | 10/2006 | Dennis et al. | |
| 2007/0192074 | A1 | 8/2007 | Chen | |
| 2007/0261886 | A1 | 11/2007 | Wilson et al. | |
| 2008/0028891 | A1 | 2/2008 | Calnan et al. | |
| 2008/0127475 | A1 | 6/2008 | Griffo | |
| 2008/0128174 | A1 | 6/2008 | Radford et al. | |
| 2008/0128175 | A1 | 6/2008 | Radford et al. | |
| 2008/0164071 | A1 | 7/2008 | Patel et al. | |
| 2008/0245574 | A1 | 10/2008 | Campbell et al. | |

OTHER PUBLICATIONS

International Search Report for International Application No. PCT/US2010/021593 dated May 20, 2010, 3 pages.

* cited by examiner

DRILLING ASSEMBLIES INCLUDING ONE OF A COUNTER ROTATING DRILL BIT AND A COUNTER ROTATING REAMER, METHODS OF DRILLING, AND METHODS OF FORMING DRILLING ASSEMBLIES

CROSS-REFERENCE TO RELATED APPLICATION

This application claims the benefit of U.S. Provisional Patent Application Ser. No. 61/146,032, filed Jan. 21, 2009, the disclosure of which is incorporated by reference herein in its entirety.

TECHNICAL FIELD

Embodiments of the invention relate to drilling devices, assemblies, and systems for use in forming wellbores in subterranean earth formations, and to methods of forming and using the same.

BACKGROUND

Wellbores (often referred to as well bores, bore holes, etc.) are formed in subterranean formations for various purposes including, for example, extraction of oil and gas from subterranean formations and extraction of geothermal heat from subterranean formations. Wellbores may be formed in subterranean formations using earth-boring tools such as, for example, drill bits (e.g., rotary drill bits, percussion bits, coring bits, etc.) for drilling wellbores and reamers for enlarging the diameters of previously drilled wellbores. Different types of drill bits are known in the art including, for example, fixed-cutter bits (which are often referred to in the art as "drag" bits), rolling-cutter bits (which are often referred to in the art as "rock" bits), and hybrid bits (which may include, for example, both fixed cutters and rolling cutters).

Fixed-cutter bits typically include a plurality of hard, durable cutting elements secured to a face region of a bit body for drilling through rock and other hard formations. These cutting elements may comprise polycrystalline diamond compact (PDC) diamond tables mounted to supporting substrates, free-standing thermally stable diamond products, or "TSPs," natural diamonds, or diamond impregnated structures. Generally, PDC cutting elements of a fixed-cutter type drill bit have either a disk shape or a substantially cylindrical shape. A cutting surface comprising the hard, superabrasive material in the form of mutually bound particles of diamond, may be provided on a substantially circular end surface of each cutting element. To drill a wellbore with a drill bit, the drill bit is rotated and advanced into the subterranean formation. The drill bit may be placed in a bore hole such that the cutting elements are adjacent the earth formation to be drilled. As the drill bit rotates, the cutters or abrasive structures thereof cut, crush, shear, and/or abrade away (depending on the formation and the type of cutting elements employed) the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which may comprise a series of elongated tubular segments connected end-to-end that extends into the wellbore from the surface of the formation. It is also known to employ coiled tubing as a drill string. Often various tools and components, including the drill bit, may be coupled together at the distal end of the drill string at the bottom of the bore hole being drilled. This assembly of tools and components is referred to in the art as a "bottom hole assembly" (BHA).

The drill bit may be rotated within the bore hole by rotating the drill string from the surface of the formation, or the drill bit may be rotated by coupling the drill bit to a down-hole motor, which is also coupled to the drill string and disposed proximate the bottom of the wellbore. The down-hole motor may comprise, for example, a hydraulic Moineau-type motor having a drive shaft, to which the drill bit is mounted, that may be caused to rotate by pumping fluid (e.g., drilling mud or fluid) from the earth's surface down through the center of the drill string and through the hydraulic motor to the drill bit, the drilling fluid being then flowing out from nozzles in the drill bit, and back up to the surface of the formation through the annulus between the outer surface of the drill string and the exposed surface of the formation defining the wall of the bore hole.

Reamers (also referred to in the art as "hole opening devices" or "hole openers") may also be used conjunction with a drill bit as part of a bottom hole assembly when drilling a wellbore in a subterranean formation. In such a configuration, the drill bit operates as a "pilot" bit to form a pilot bore in the subterranean formation. As the drill bit and bottom hole assembly advance into the formation, the reamer device follows the drill bit through the pilot bore and enlarges the diameter of, or "reams," the pilot bore.

As a bore hole is being drilled in a formation, weight and torque is applied to the drill string to turn the drill bit and any reamer employed therewith. The axial force or "weight" applied to the drill bit (and reamer, if used) to cause the drill bit to advance into the formation as the drill bit drills the bore hole is referred to in the art as the "weight-on-bit" (WOB).

BRIEF SUMMARY OF THE INVENTION

In some embodiments, the present invention includes drilling assemblies that include a drill string, a reamer apparatus, a motor (e.g., a downhole motor), and a drill bit. The drill bit and the reamer apparatus are configured to rotate in opposite rotational directions during drilling operations. For example, the drilling assembly may include a motor having an outer housing and a drive shaft. The outer housing of the motor may be coupled to a drill string and configured to rotate about the longitudinal axis of the drill string in unison with rotation of the drill string about the longitudinal axis. Further, the motor may be configured to rotate the drive shaft in a second rotational direction opposite the first rotational direction about the longitudinal axis of the drill string. A drill bit for drilling a wellbore may be coupled to the drive shaft of the motor and may be configured for rotation in the second rotational direction about the longitudinal axis of the drill string. A reamer apparatus may be coupled to one of the drill string and the outer housing of the motor. The reamer apparatus may be configured to rotate about the longitudinal axis of the drill string in unison with at least a portion of the drill string for enlarging a diameter of a wellbore drilled by the drill bit. At least a portion of the reamer apparatus may extend longitudinally relative to the wellbore and radially beyond at least a portion of the drill bit; in some embodiments a portion of the reamer apparatus may be located radially adjacent to the drill bit.

In additional embodiments, the present invention includes methods of drilling a wellbore in a subterranean formation. An earth-boring rotary drill bit may be rotated within a wellbore in a first rotational direction about a longitudinal axis of a drill string to which the drill bit is coupled to drill the wellbore. A reamer apparatus may be rotated in unison with at least a portion of the drill string and about at least a portion of the drill bit in a second rotational direction opposite the first rotational direction to ream the wellbore.

In additional embodiments, the present invention includes methods of forming a drilling assembly. A drill bit may be configured to drill a wellbore in a subterranean formation when rotating in a counter-clockwise direction from a perspective looking down the wellbore. A downhole motor may be configured to rotate a drive shaft thereof in a counter-clockwise direction from the perspective looking down the wellbore when drilling fluid is pumped through the motor to the drill bit. The drill bit may be attached to the drive shaft of the downhole motor. A reamer apparatus may be configured to ream the wellbore within the subterranean formation when rotating in a clockwise direction from the perspective looking down the wellbore. The reamer apparatus may be removably attached to an outer housing of the downhole motor.

In additional embodiments, the drilling assembly may include a drill string configured for rotation in a first rotational direction about a longitudinal axis of the drill string. A reamer apparatus may be coupled to the drill string and may be configured to rotate about the longitudinal axis of the drill string in unison with at least a portion of the drill string. A motor having an outer housing and a drive shaft may be configured to rotate the drive shaft in a second rotational direction opposite the first rotational direction about the longitudinal axis of the drill string. The outer housing of the motor may be at least partially disposed within the reamer apparatus and may be configured to rotate about the longitudinal axis of the drill string in unison with the reamer apparatus. A drill bit may be coupled to the drive shaft of the motor and may be configured for rotation in the second rotational direction about the longitudinal axis of the drill string.

BRIEF DESCRIPTION OF THE SEVERAL VIEWS OF THE DRAWINGS

While the specification concludes with claims particularly pointing out and distinctly claiming that which is regarded as the present invention, various features and advantages of this invention may be more readily ascertained from the following description of the invention when read in conjunction with the accompanying drawings, in which:

DETAILED DESCRIPTION OF THE INVENTION

The illustrations presented herein are not actual views of any particular drilling system, assembly, or device, but are merely idealized representations, which are employed to describe embodiments of the present invention.

Figure 1:
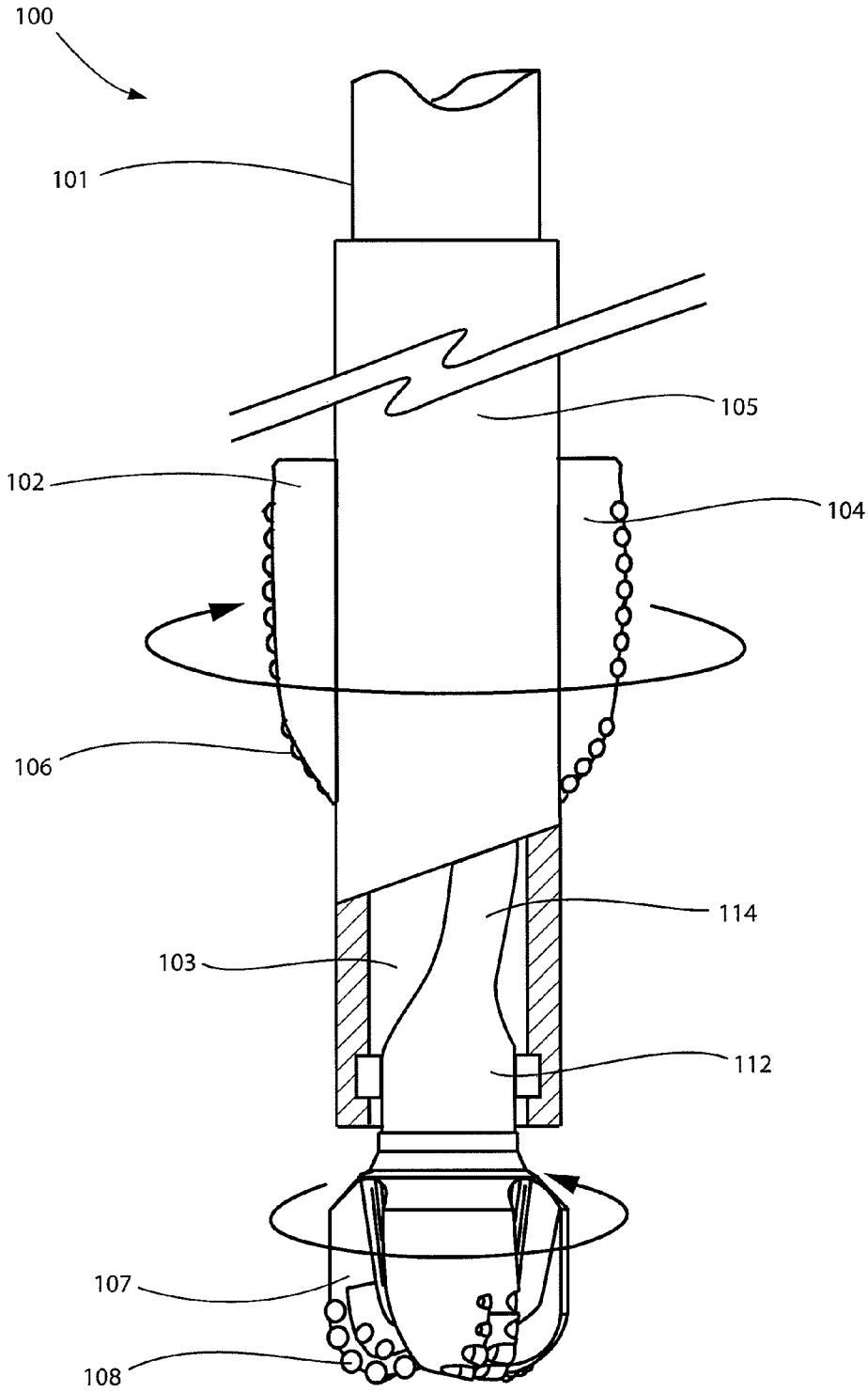
FIG. 1 is a partial longitudinal cross-sectional view of a drilling assembly of the present invention that includes a reamer apparatus and a drill bit.

An embodiment of a drilling assembly 100 of the present invention is shown in FIG. 1. A drill string 101 may extend between a surface assembly (not shown) disposed at a surface of a subterranean formation and a bottom hole assembly (BHA) disposed at the bottom of a wellbore that is being drilled in the subterranean formation. The surface assembly may include conventional equipment (e.g., a rotary table or top drive, not shown) for rotating the drill string 101 about a longitudinal axis of the drill string 101. The bottom hole assembly is shown in FIG. 1 and includes a reamer apparatus 102, a motor 103, and an earth-boring rotary drill bit 107, depicted as a fixed cutter or drag bit employing PDC cutting elements, although of course the invention is not so limited. In the embodiment shown in FIG. 1, the drill string 101 is directly coupled to the reamer apparatus 102, the reamer apparatus 102 is directly coupled to the motor 103, and the motor 103 is directly coupled to the drill bit 107. It is understood that bottom hole assemblies may include various other components, and embodiments of the present invention may include such other components and are not limited to the components shown in the figures.

The reamer apparatus 102 may comprise one or more cutting features such as blades 104 or wings each having cutting elements 106 (e.g., PDC cutting elements, tungsten carbide compacts, cutting elements, and impregnated cutting element inserts, etc.) disposed thereon. In some embodiments, the reamer apparatus 102 may comprise an expandable reamer apparatus having blades that may be selectively moved in radially inward and radially outward directions (perpendicular or at an acute angle to the longitudinal axis of the drill string 101). In other embodiments, the reamer apparatus 102 may have fixed blades in a concentric or eccentric configuration. By way of example and not limitation, the reamer apparatus 102 may comprise a reamer apparatus as disclosed, for example, in U.S. patent application Ser. No. 11/949,627, which was filed Dec. 3, 2007 and entitled "Expandable Reamers For Earth-Boring Applications And Methods Of Using The Same," and in U.S. patent application Ser. No. 11/949,259, which was filed Dec. 3, 2007 and entitled "Expandable Reamers For Earth Boring Applications," the entire disclosure of each of which is incorporated herein by this reference. The reamer apparatus 102 is used to ream or enlarge the diameter of the wellbore previously drilled by the drill bit 107 as the reamer apparatus 102 passes through the wellbore.

As previously mentioned, the reamer apparatus 102 may be attached to a downhole motor 103. In some embodiments, the reamer apparatus 102 may be directly attached to an outer housing 105 of the motor 103. The outer housing 105 of the motor 103 may comprise a stator of the motor 103. The downhole motor 103 may comprise, for example, a so-called "Positive Displacement Motor" (PDM) or hydraulic Moineau-type motor such as those disclosed in U.S. Pat. No. 6,142,228 to Jogi et al., which issued Nov. 7, 2000, the entire disclosure of which is incorporated herein by this reference. The motor 103 may comprise a rotor 114 and a drive shaft 112, to which the drill bit 107 is mounted. The motor 103 is configured to rotate the rotor 114 and drive shaft 112 coupled thereto in a direction opposite the direction of rotation of the drill string 101, as discussed in further detail below. The rotor 114 of the motor 103 may be caused to rotate by pumping fluid (e.g., drilling mud or fluid) from the surface of the formation down through the center of the drill string 101, through the hydraulic motor 103, out from nozzles in the drill bit 107, and back up to the surface of the formation through an annulus between an outer surface of the drill string 101 and an exposed surface of the formation defining a wall of the bore hole. As hydraulic drilling fluid is pumped from the surface down through the drill string 101 and through the motor 103 to the drill bit 107, the flow of the hydraulic fluid through the motor 103 will cause the rotor 114 and the drive shaft 112 of the motor 103 to which the drill bit 107 is coupled to rotate about the longitudinal axis of the drill string 101.

The earth-boring rotary drill bit 107 may comprise any type of earth-boring rotary drill bit known in the art, such as, by way of non-limiting example, a fixed-cutter drill bit (as shown in FIG. 1), a roller cone drill bit, a diamond impregnated drill bit, a hybrid bit, etc. The drill bit 107 shown in FIG. 1 is a fixed-cutter drill bit having a plurality of cutting elements 108 (e.g., PDC cutting elements) fixedly attached to each of a plurality of blades or wings. As used herein, the term "cutting surface" means any surface of a drill bit configured to cut, crush, shear, and/or abrade away the formation material to form or enlarge a bore hole.

In some embodiments, the motor 103 of the drilling assembly 100 may comprise a counter-rotating drive shaft 112 configured to rotate the drill bit 107 in a counter-clockwise direction (from the perspective of looking down the bore hole toward the drill bit 107 and the bottom of the wellbore) as drilling fluid is pumped through the motor 103 to the drill bit 107, and the drill bit 107 may comprise a counter-rotating drill bit 107.

Historically, drill bits have been manufactured to rotate in a clockwise direction. In other words, the cutting elements are positioned and oriented to cut the underlying formation as the drill bit is rotated in the clockwise direction. Furthermore, the threads (not shown) securing the drill bit to a motor or a drill string (or other components of a bottom hole assembly) are configured such that the drill bit 107 will not be unthreaded from the motor 103 or the drill string 101 as the drill bit 107 is rotated in the clockwise direction by the motor 103 or the drill string 101.

The cutting elements 108 of the drill bit 107 shown in FIG. 1 are positioned and oriented to cut the underlying formation as the drill bit 107 is rotated in the counter-clockwise direction, and the threads (not shown) securing the drill bit 107 to the drive shaft 112 of the motor 103 are configured such that the drill bit 107 will not be unthreaded from the drive shaft 112 of the motor 103 as the drill bit 107 is rotated in the counter-clockwise direction by the motor 103. By way of example and not limitation, the drill bit 107 may comprise a conventional threaded connection that is attached using the maximum allowable torque on the connection to reduce the likelihood that the drill bit 107 will unthread itself from the drive shaft 112 during drilling operations.

In operation, the drill string 101 of the drilling assembly 100 may be rotated in the conventional clockwise direction by a surface drive assembly at the surface of the formation being drilled. As the reamer apparatus 102 is attached directly to the drill string 101, rotation of the drill string 101 in the clockwise direction will cause the reamer apparatus 102 to also rotate in the clockwise direction to ream and enlarge the diameter of the wellbore. As the drill string 101 is rotated in the clockwise direction, however, drilling fluid may be pumped through the drill string 101 and the motor 103 to the drill bit 107, which causes the rotor 114 and drive shaft 112 of motor 103 to rotate the drill bit 107 in the counter-clockwise direction as the drill bit 107 drills the wellbore.

By causing the reamer apparatus 102 and the drill bit 107 to rotate in opposite directions about the longitudinal axis of the drill string 101, the torque generated by the interaction of the drill bit 107 with the formation will at least partially counteract the torque generated by the interaction of the reamer apparatus 102 with the formation. The torque on the drill string 101 above and proximate the bottom hole assembly may be approximately equal to the torque generated by the reamer apparatus 102 minus the torque generated by the drill bit 107. In other words, some of the reactive torque of the drill bit 107 and the motor 103 will assist in rotating the reamer apparatus 102, which may allow the surface drive assembly to rotate the drill string 101 and the reamer apparatus 102 with less applied torque (torque applied by the surface assembly to the drill string 101). As a result, the total torque that must be applied to the drill string 101 by the surface drive assembly to efficiently drill the wellbore may be reduced relative to previously known methods. Furthermore, a reduction in the torque applied to the drill string by the surface assembly may reduce the occurrence of the phenomenon known in the art as "stick-slip," which results when the drill bit and/or reamer apparatus momentarily sticks in place relative to the formation, and, as the torque applied to the drill string increases, slips into rapid rotation until again sticking in place relative to the formation. This sticking and slipping process may repeat itself relatively rapidly, resulting in wide variations in the torque on the drill string. Additionally, the stick-slip phenomenon may result in damage to the cutting elements of the drill bit and/or the reamer apparatus as the drill string intermittently rotates.

Although the embodiment of FIG. 1 includes a counter-rotating drill bit 107 and a motor 103 configured to rotate the drill bit 107 in the counter-clockwise direction while the drill string 101 is rotated in the clockwise direction by the surface drive assembly, similar results may be achieved by rotating the drill string 101 (and, hence, the reamer apparatus 102) in the counter-clockwise direction using the surface assembly, and using a conventional clockwise rotating drill bit and a conventional motor configured to rotate the drill bit in the clockwise direction as the drill string 101 rotates in the counter-clockwise direction. However, such an approach may require the drill string and bottom hole assembly components secured thereto above the drill bit to employ couplings threaded in a direction opposite to that of conventional threads employed in drill strings.

As viewed relative to the wellbore, the output of the motor 103 is the difference between the rotational speed of the drill string 101 (and the outer housing of the motor 103) and the rotational speed of the drive shaft 112 of the motor 103, since the drive shaft 112 of the motor 103 is rotating opposite the drill string 101. Generally, the drive shaft 112 of the motor 103 will rotate faster than the drill string 101 such that the drill bit 107 turns opposite the direction of the drill string 101 relative to the formation.

Figure 2:
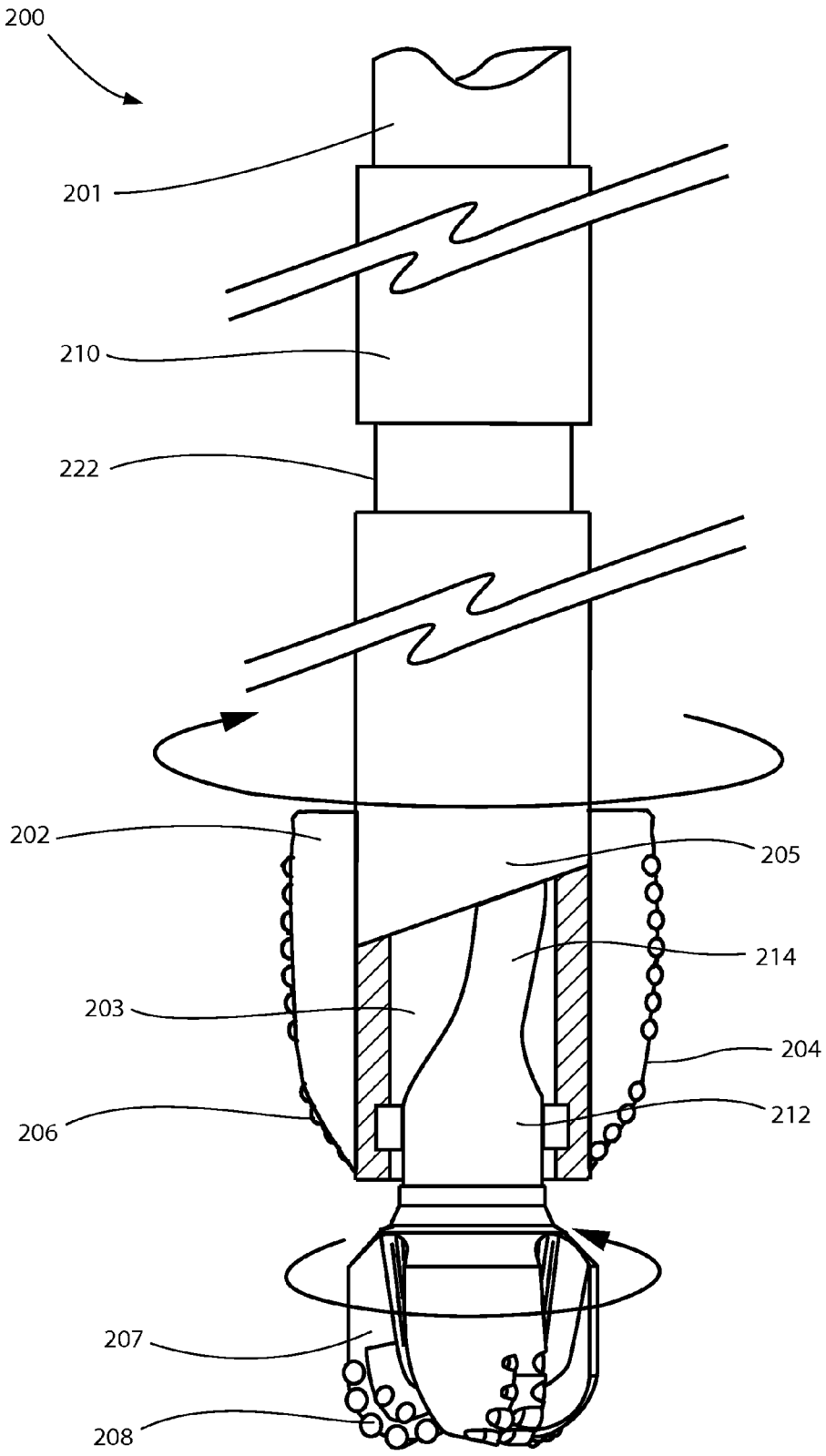
FIG. 2 is a partial longitudinal cross-sectional view of another embodiment of a drilling assembly of the present invention that includes a reamer apparatus located proximate to a drill bit.

In some embodiments, it may be desirable to provide a reamer apparatus of a bottom hole assembly relatively close to, or even as close as possible to, a drill bit of the bottom hole assembly. Another embodiment of a drilling assembly 200 of the present invention is shown in FIG. 2. The drilling assembly 200 is substantially similar to the drilling assembly 100 previously described with reference to FIG. 1, and includes a drill string 201 coupled to an outer housing 205 of a downhole motor 203. The outer housing 205 is coupled to a reamer apparatus 202, which may comprise a part of downhole motor 203 or be mounted to the exterior of outer housing 205. A rotor 214 and drive shaft 212 of the motor 203 are attached to a drill bit 207 having cutting elements 208.

In the embodiment of FIG. 2, the drill string 201 is directly coupled to the motor 203, and the reamer apparatus 202 is attached to the outer housing 205 of the motor 203 at the end thereof proximate the drill bit 207. The reamer apparatus 202 may comprise blades 204 each having cutting elements 206. In some embodiments, the reamer apparatus 202 may have a length that is approximately one-half or less of a length of the outer housing 205 of the motor 203, and the reamer apparatus 202 may be substantially entirely located on the half of the outer housing 205 of the motor 203 proximate the drill bit 207. In additional embodiments, the reamer apparatus 202 may have a length that is approximately one-quarter or less of a length of the outer housing 205 of the motor 203, and the reamer apparatus 202 may be substantially entirely located on the quarter of the outer housing 205 of the motor 203 most proximate the drill bit 207. In this manner, the reamer apparatus 202 may be positioned relatively close to, or even as close as possible to, the drill bit 207.

Furthermore and as noted above, the reamer apparatus 202 may be at least partially integrally formed with the outer housing 205 of the motor 203, or the reamer apparatus 202 may comprise an entirely separate apparatus relative to the outer housing 205 of the motor 203 and may be attached to the body 205 of the motor 203.

In operation, the drill string 201 of the drilling assembly 200 may be rotated in the conventional clockwise direction by the surface assembly at the surface of the formation being drilled. As the reamer apparatus 202 is attached directly to the outer housing 205 of the motor 203 and, hence, to the drill string 201, rotation of the drill string 201 in the clockwise direction will cause the reamer apparatus 202 to also rotate in the clockwise direction as the reamer apparatus 202 reams the wellbore to a larger diameter. As the drill string 201 is rotated in the clockwise direction, however, drilling fluid may be pumped through the drill string 201 and the motor 203 to the drill bit 207, which causes the rotor 214 and drive shaft 212 of motor 203 to rotate the drill bit 207 in the counter-clockwise direction as the drill bit 207 drills the wellbore. In other embodiments, the drill string 201 (and, hence, the reamer apparatus 202) may be rotated in the counter-clockwise direction using the surface assembly, and a conventional motor may be used to rotate a conventional drill bit in the clockwise direction as the drill string 201 rotates in the counter-clockwise direction.

In some embodiments, the drilling assembly 200 may include a second motor 210 having, for example, a drive shaft 212 and a rotor similar to the previously described motor 203. However, the second motor 210 is configured to rotate a portion of the drill string 201 in a direction opposite the direction of the first described motor 203. That is, in some embodiments, the drill string 201 may not be rotated by a surface assembly, but rather, a second motor 210 located on the drill string 201 may rotate the portion of bottom hole assembly attached to the drive shaft 222 of the second motor 210. For example, as shown in FIG. 2, rotation of the drive shaft of the second motor 210 causes rotation of the motor 203, reamer apparatus 202, and drill bit 207 coupled to the drive shaft 222 of the second motor 210.

Figure 3:
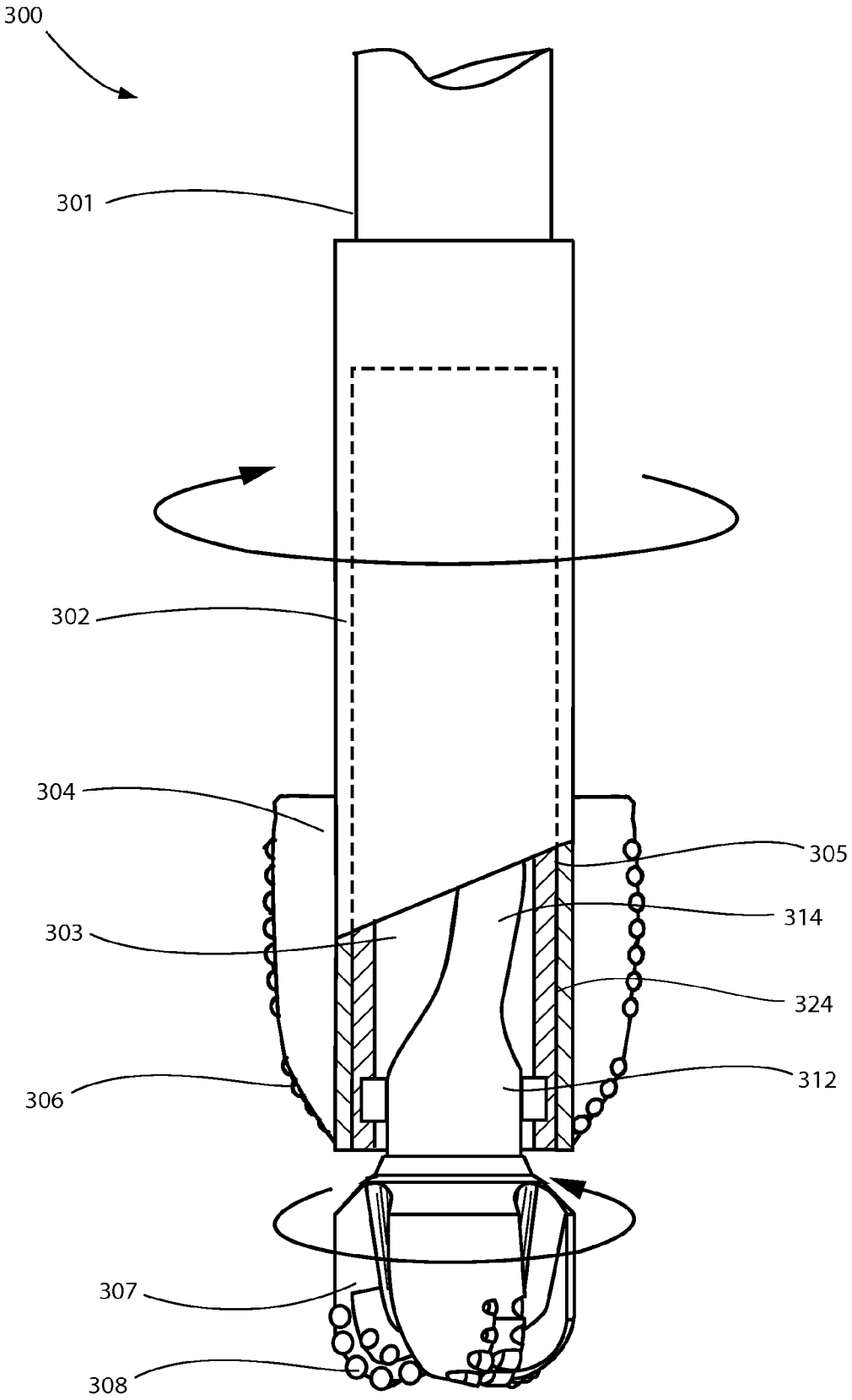
FIG. 3 is a partial longitudinal cross-sectional view of yet another embodiment of a drilling assembly of the present invention that includes a reamer apparatus, a drill bit, and a motor at least partially disposed within the reamer apparatus.

Another embodiment of a drilling assembly 300 of the present invention is shown in FIG. 3. The drilling assembly 300 is substantially similar to the drilling assemblies 100 and 200 previously described with reference to FIGS. 1 and 2, respectively, and includes a drill string 301 coupled to a reamer apparatus 302. The drilling assembly 300 also includes a motor 303 having an outer housing 305. A rotor 314 and drive shaft 312 of motor 303 are attached to a drill bit 307 having cutting elements 308 formed thereon.

In the embodiment of FIG. 3, the drill string 301 is directly coupled to a body of the reamer apparatus 302, and the motor 303 is disposed at least partially within the body of the reamer apparatus 302. For example, the reamer apparatus 302 may include a body having a longitudinal bore 324 formed therein and the motor 303 may be at least partially disposed within the longitudinal bore 324. The motor 303 may be directly coupled to the reamer apparatus 302, to the drill string 301, or to both the reamer apparatus 302 and the drill string 301. A plurality of blades 304 having cutting elements 306 thereon are provided on an end of the reamer apparatus 302 proximate the drill bit 307 such that the blades are disposed circumferentially about the motor 303 proximate the drill bit 307. In some embodiments, the blades 304 of the reamer apparatus 302 may be disposed circumferentially about one half of a length of the outer housing 305 of the motor 303 proximate the drill bit 307, as shown in FIG. 3. In additional embodiments, the blades 304 of the reamer apparatus 302 may be disposed circumferentially about one quarter of a length of the outer housing 305 of the motor 303 proximate the drill bit 307. In this additional manner, the blades 304 of the reamer apparatus 302 may be positioned relatively close to, or even as close as possible to, the drill bit 307.

The reamer apparatus 302 may comprise a separate apparatus relative to the outer housing 305 of the motor 303 and may be attached to the outer housing 305 of the motor 303. In some embodiments the reamer apparatus 302 may comprise an expandable reamer apparatus 302 configured to selectively position at least one blade 304 of the expandable reamer apparatus relative to the longitudinal axis of the drill string 301. As mentioned above, such devices are described in greater detail in U.S. patent application Ser. No. 11/949,627 now U.S. Pat. No. 7,997,354, issued Aug. 16, 2011, and in U.S. patent application Ser. No. 11/949,259, now U.S. Pat. No. 7,900,717, issued Mar. 8, 2011, which have been incorporated by reference herein.

In operation, the drill string 301 of the drilling assembly 300 may be rotated in the conventional clockwise direction by the surface assembly at the surface of the formation being drilled. As the reamer apparatus 302 is attached directly to the outer housing 305 of the motor 303 and, hence, to the drill string 301, rotation of the drill string 301 in the clockwise direction will cause the reamer apparatus 302 to also rotate in the clockwise direction as the reamer apparatus 302 reams the wellbore. As the drill string 301 is rotated in the clockwise direction, drilling fluid may be pumped through the drill string 301 and the motor 303 to the drill bit 307, which causes the motor 303 to rotate the drill bit 307 in the counter-clockwise direction as the drill bit 307 drills the wellbore. In other embodiments, the drill string 301 (and, hence, the reamer apparatus 302) may be rotated in the counter-clockwise direction using the surface assembly, and a conventional motor may be used to rotate a conventional drill bit in the clockwise direction as the drill string 301 rotates in the counter-clockwise direction.

Figure 4:
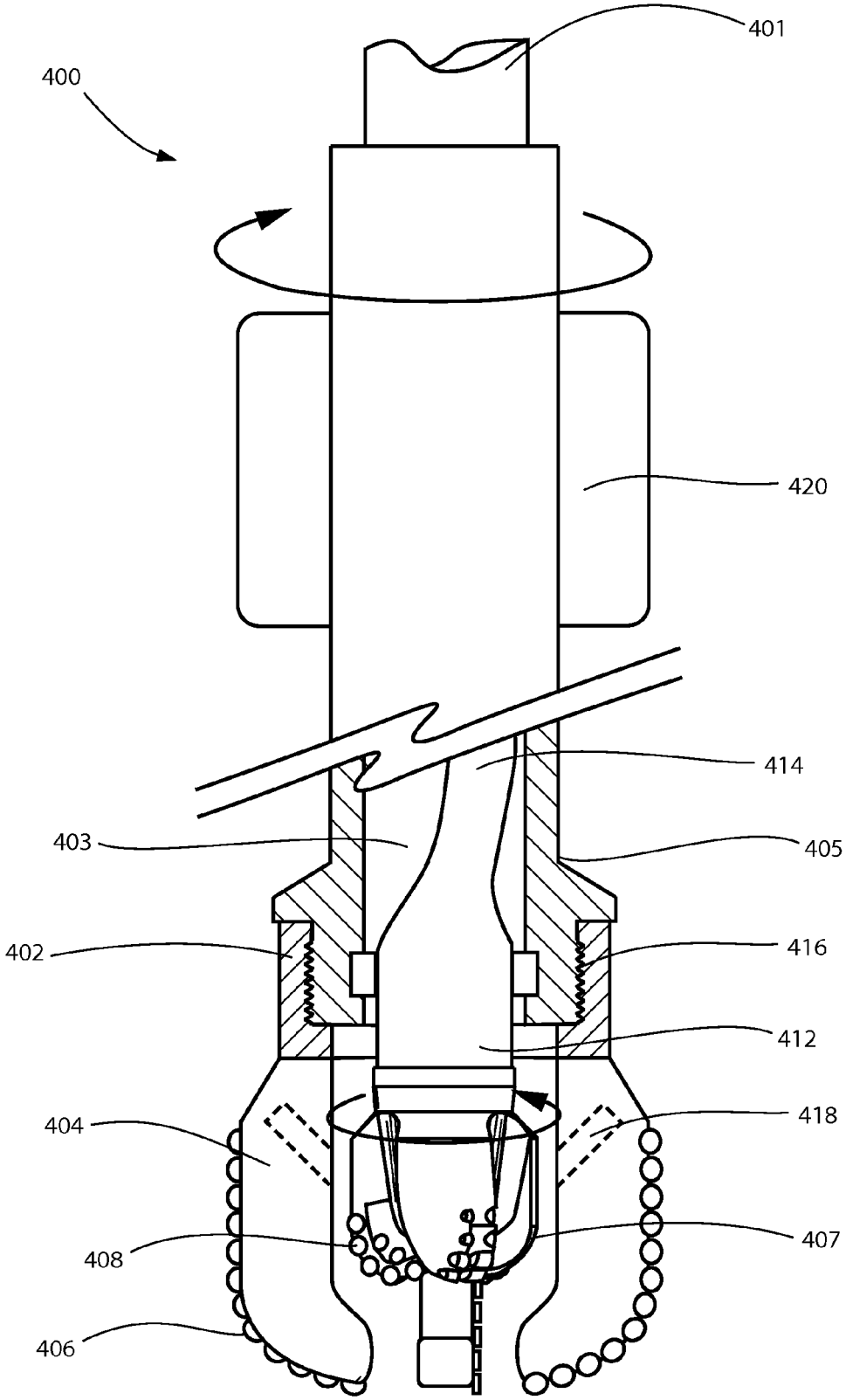
FIG. 4 is a partial longitudinal cross-sectional view of yet another embodiment of a drilling assembly of the present invention that includes a reamer apparatus extending longitudinally along at least a portion of a drill bit.

Another embodiment of a drilling assembly 400 of the present invention is shown in FIG. 4. The drilling assembly 400 is substantially similar to the drilling assemblies 100, 200, and 300 previously described with reference to FIGS. 1, 2, and 3, respectively, and includes a drill string 401 coupled to a reamer apparatus 402. The drilling assembly 400 also includes a motor 403 having an outer housing 405 and a rotor 414. A drive shaft 412 of the motor 403 is attached to a drill bit 407 having cutting elements 408 formed thereon.

In the embodiment of FIG. 4, however, the drill string 401 is directly coupled to the motor 403, and the reamer apparatus 402 is attached to and disposed on the end of the motor 403 such that the blades 404 of the reamer apparatus 402 extend longitudinally radially adjacent at least a portion of the drill bit 407. In other words, at least a portion of the blades 404 may be disposed laterally alongside at least a portion of the drill bit 407.

The reamer apparatus 402 may comprise a separate apparatus relative to the body 405 of the motor 403 and may be attached to the outer housing 405 of the motor 403. By way of example and not limitation, the outer housing 405 of the motor 403 may include an attachment portion such as a threaded portion 416 formed thereon. The threaded portion 416 may be configured to matingly engage a complementary threaded portion of the reamer apparatus 402. A proximal end of the reamer apparatus 402 may comprise a substantially annular shape configured to attach to the outer housing 405 of the motor 403. Further, a distal portion of the reamer apparatus 402 may include a plurality of blades 404 extending longitudinally from the motor 403 and radially adjacent at least a portion of the drill bit 407. The blades 404 may each have a plurality of cutting elements 406. It is noted that while the current embodiment of FIG. 4 is directed at attaching the reamer apparatus 402 to the outer housing 405 of the motor 403 using a threaded connection, other suitable connections may be utilizing including, but limited to, an adhesive connection, a welded connection, or a fastened connection.

In some embodiments, the reamer apparatus 402 may include at least one port 418 formed therein configured to supply drilling fluid from the drill string 401. The at least one port 418 may be located on the reamer apparatus 402 at a location such as one of the blades 404 and may supply drilling fluid to the drill bit 407 (e.g., direct drilling fluid directly onto the drill bit 407) during drilling operations. For example, drilling fluid may be supplied to the port 418 from areas such as internal fluid passageways located in the drill string 401, motor 403, and reamer apparatus 402. The port 418 may further comprise a nozzle or other suitable elements to provide drilling fluid to the drill bit 407. It is also contemplated by the current invention that a location on the drill string 401 such as the outer housing 405 of the motor 403 may include selectively laterally moveable ribs or pads 420 that allow the bottom hole assembly to be steered along a desired trajectory. Such systems utilizing ribs to steer a drill string are disclosed, for example, in U.S. Pat. No. 7,413,032, issued Aug. 19, 2008, entitled "Self-controlled Directional Drilling Systems and Methods" and assigned to the assignee of the present invention, the entire disclosure of which is incorporated herein by this reference.

In operation, the drill string 401 of the drilling assembly 400 may be rotated in the conventional clockwise direction by the surface assembly at the surface of the formation being drilled. As the reamer apparatus 402 is attached directly to the outer housing 405 of the motor 403 and, hence, to the drill string 401, rotation of the drill string 401 in the clockwise direction will cause the reamer apparatus 402 to also rotate in the clockwise direction as the reamer apparatus 402 reams to enlarge the diameter of the wellbore. In some embodiments, the reamer apparatus 402 may be attached to the outer housing 405 of the motor 403 and positioned such that a portion of the reamer apparatus 402 rotates about a portion of the drill bit 407. As the drill string 401 is rotated in the clockwise direction, drilling fluid may be pumped through the drill string 401 and the motor 403 to the drill bit 407, which causes the motor 403 to rotate the drill bit 407 in the counter-clockwise direction as the drill bit 407 drills the wellbore. In other embodiments, the drill string 401 (and, hence, the reamer apparatus 402) may be rotated in the counter-clockwise direction using the surface assembly, and a conventional motor may be used to rotate a conventional drill bit in the clockwise direction as the drill string 401 rotates in the counter-clockwise direction.

Figure 5:
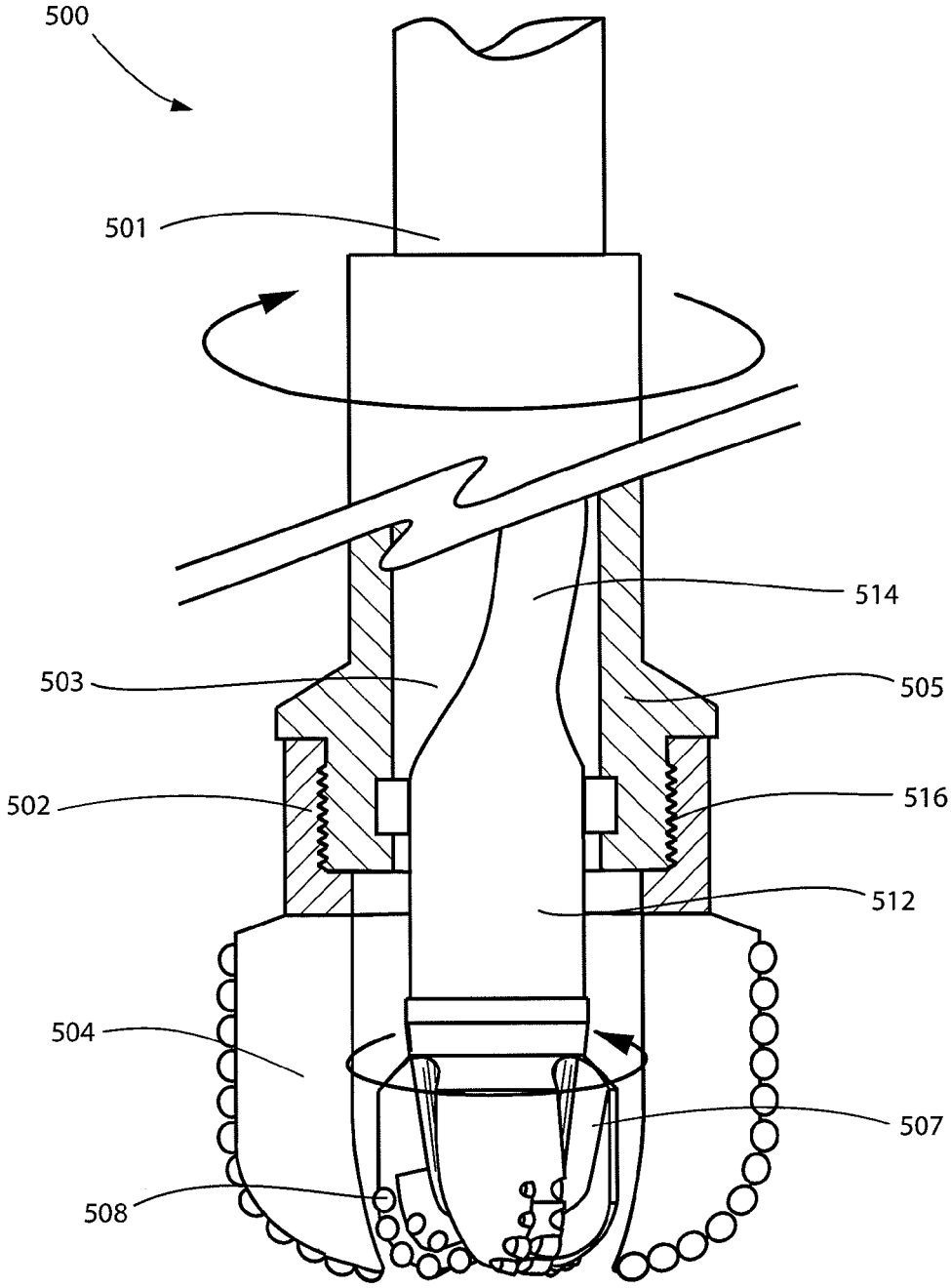
FIG. 5 is a partial longitudinal cross-sectional view of yet another embodiment of a drilling assembly of the present invention that includes a reamer apparatus extending longitudinally along at least a portion of a drill bit.

An additional embodiment of a drilling assembly 500 is shown in FIG. 5. The drilling assembly 500 is substantially similar to the drilling assemblies 100, 200, 300, and 400 previously described with reference to FIGS. 1, 2, 3 and 4, respectively, and includes a drill string 501 coupled to a reamer apparatus 502. The drilling assembly 500 also includes a motor 503 having an outer housing 505 and a rotor 514. A drive shaft 512 of the motor 503 is attached to a drill bit 507 having cutting elements 508 formed thereon. As shown in FIG. 5, however, the reamer apparatus 502 is attached to and disposed on the end of the motor 503 such that the distal end of the reamer apparatus 502 extends to substantially the same plane as the distal end of the drill bit 507. In other words, the blades 504 of the reamer apparatus 502 and the drill bit 507 will both be in contact with a planar surface at the bottom of the bore hole. In some embodiments, the reamer apparatus 502 may be attached to and disposed on the end of the motor 503 such that the distal end of the drill bit 507 extends past the distal end of the reamer apparatus 502. In other words, the distal end of the drill bit 507 is not surrounded by the reamer apparatus 502, but rather, the reamer apparatus 502 only surrounds a portion of the drill bit 507.

Similar to the apparatus depicted in FIG. 4, the reamer apparatus 502 may be attached to the outer housing 505 of the motor 503 at a threaded portion 516 formed on the outer housing 505 of the motor 503. In operation similar to the embodiments described above, the drill string 501, reamer apparatus 502, and motor 503 may be rotated in the conventional clockwise direction by the surface assembly at the surface of the formation being drilled. Drilling fluid may be pumped through the drill string 501 and the motor 503 to the drill bit 507, which causes the motor 503 to rotate the drill bit 507 in the counter-clockwise direction as the drill bit 507 drills the wellbore. In other embodiments, the drill string 501 (and, hence, the reamer apparatus 502) may be rotated in the counter-clockwise direction using the surface assembly, and a conventional motor may be used to rotate a conventional drill bit in the clockwise direction as the drill string 501 rotates in the counter-clockwise direction.

Figure 6:
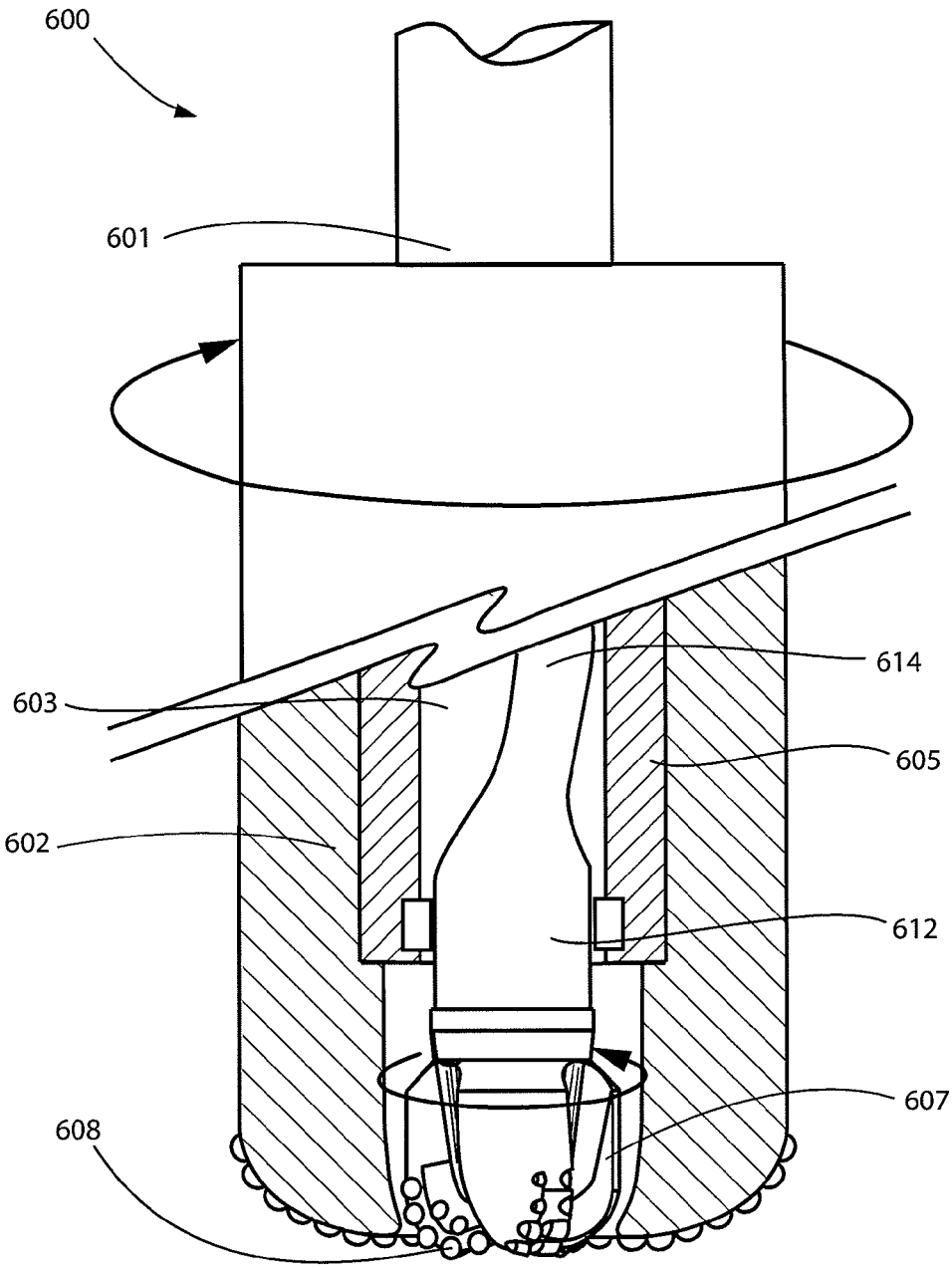
FIG. 6 is a partial longitudinal cross-sectional view of yet another embodiment of a drilling assembly of the present invention that includes a reamer apparatus such as a core bit and a drill bit.

An additional embodiment of a drilling assembly 600 is shown in FIG. 6. The drilling assembly 600 is substantially similar to the drilling assemblies 100, 200, 300, 400, and 500 previously described with reference to FIGS. 1, 2, 3, 4, and 5, respectively. The drilling assembly 600 includes a motor 603 having an outer housing 605 and a rotor 614. A drive shaft 612 of the motor 603 is attached to a drill bit 607 having cutting elements 608 formed thereon. In the embodiment of FIG. 6, however, the reamer apparatus 602 coupled to the drill string 601 may comprise a tubular shape rather than a plurality of blades. As shown in FIG. 6, the reamer apparatus 602 is attached to and disposed on the drill string 601 and substantially surrounds the drill bit 607. As with previously described embodiments, the reamer apparatus 602 and the drill bit 607 may be aligned in various configurations such as the distal end of reamer apparatus 602 and the distal end of the drill bit 607 may reside in substantially the same plane, the drill bit 607 may extend at least partially past the distal end of the reamer apparatus 602, or the reamer apparatus 602 may extend past the distal end of the drill bit 607.

Similar to the arrangement depicted in FIG. 3, the outer housing 605 of the motor 603 may be at disposed within the reamer apparatus 602. In operation similar to the embodiments described above, the drill string 601, reamer apparatus 602, and motor 603 may be rotated in the conventional clockwise direction by the surface assembly at the surface of the formation being drilled. Drilling fluid may be pumped through the drill string 601 and the motor 603 to the drill bit 607, which causes the motor 603 to rotate the drill bit 607 in the counter-clockwise direction as the drill bit 607 drills the wellbore. In other embodiments, the drill string 601 (and, hence, the reamer apparatus 602) may be rotated in the counter-clockwise direction using the surface assembly, and a conventional motor may be used to rotate a conventional drill bit in the clockwise direction as the drill string 601 rotates in the counter-clockwise direction.

Referring again to FIG. 5, a method of forming a drilling assembly as shown in the embodiments described above is now discussed. The method of forming a drilling assembly includes configuring a drill bit 507 to drill a subterranean formation when rotating in a counter-clockwise direction and configuring a downhole motor 503 to rotate a drive shaft 512 and a drill bit 507 coupled thereto in a counter-clockwise direction when drilling fluid is pumped through the motor 503. Further, a reamer apparatus 502 may be configuring to ream a wellbore within the subterranean formation when rotating in a clockwise direction opposite to the drill bit 507. An outer housing 505 of the downhole motor 503 may be configured to receive the reamer apparatus 502 and the reamer apparatus 502 may be removably attached to the outer housing 505. In some embodiments, the outer housing 505 may be configured to receive the reamer apparatus 502 by providing a threaded portion 516 thereon. The reamer apparatus 502 may be removably attached to the motor 503 by threading the reamer apparatus 502 to the threaded portion 516 of the outer housing 505 of the motor 503. In some embodiments, the reamer apparatus 502 may be positioned to extend longitudinally radially adjacent at least a portion of at least one cutting surface of the drill bit 507. In other embodiments, the reamer apparatus 502 may be positioned to substantially laterally surround a portion of the drill bit 507. For example, a reamer apparatus 502 such as the reamer apparatus 602 (FIG. 6) may be configured to entirely, laterally surround a portion of the drill bit 507.

In operation using the described counter drill bit systems 100, 200, 300, 400, 500, and 600 the drill bit and the reamer can be operated at different selected angular speeds (i.e., revolutions per minute). The angular speed of the reamer will be determined by the angular speed of the drill string, while the angular speed of the drill bit will be determined by both the angular speed of the drill string and the opposing angular speed of the drive shaft of the motor to which the drill bit is attached. For example, it may be possible to rotate the drill bit at a rate resulting in a maximum rate of penetration (ROP) for the drill bit. Such a rate, while ideal for the drill bit, will often be too high for the reamer and would result in excessively high operating temperatures of the reamer. When the angular velocity of a reamer is the same as that of an associated drill bit, the tangential velocity of the reamer (the speed with which the cutting elements thereon move relative to the formation) will be greater than the drill bit, since the reamer has a larger outer diameter than the drill bit. In order to operate the reamer at an ideal rate, the rotor/stator lobe ratios of the motor in embodiments of the present invention may be selected, in combination with drilling fluid flow rate through the motor, to rotate the drill bit at an angular velocity higher than that of the reamer, such that both the reamer and the drill bit rotate at different angular velocities that result in a desirable (e.g., maximum) rate of penetration.

Furthermore, the reamer apparatus and the drill bit may be designed and operated using parameters selected to provide a predetermined amount of torque on the drill string at the surface of the formation. In additional embodiments, instead of achieving a desirable or maximum rate of penetration for the reamer and the drill bit, the angular velocities of the reamer and the drill bit may be selected to balance the torque within the drill string. For example, since the drill bit rotates opposite the direction of the reamer, the angular velocity of the body of the motor relative to the formation, and the angular velocity of the drive shaft of the motor relative to the formation, can be selected such that a net zero torque or a reduced torque is exhibited on the drill string. In other words, instead of managing (e.g., selecting) the speed of the drill bit and the reamer to maximize or increase the rate of penetration into the formation, the speed of the drill bit and the reamer may be managed to reduce or substantially eliminate torque on the drill string. By reducing the torque within the drill string, the slip-stick phenomenon may be reduced or even substantially eliminated. In some embodiments, however, it may be desirable to maintain some reduced level of torque of the drill string to prevent the drill string components from separating from one another (e.g., unthreading).

In view of the above, embodiments of the present invention may be particularly useful to reduce the torque required to turn a drilling bit such as a drag bit, thereby, reducing the slip-stick vibration of the drill string. Because of the length of the drill string, the applied torque winds the drill string like a torsion spring as the torque is transmitted to the drag bit at the distal end thereof. As a consequence, if a drag bit releases from consistent contact with the formation being drilled, the drill string will unwind and rotate backward, potentially damaging the PDC cutters and the bit itself, as well as losing tool face orientation if directional drilling is being performed. As the length of the drill string increases, the spring constant of the drill string decreases, furthering the potential for catastrophic slip-sticking. Furthermore, increased torque is required to rotate larger diameter fixed-cutter drag bits and drilling rigs are often only capable of applying a certain maximum torque to the drill string, which may be insufficient to rotate such larger diameter drill bits. Therefore, by reducing the amount of torque necessary to rotate a drill string, embodiments of the present invention may allow the torque applied to and present in a drill string to be controlled and reduced and, under certain drilling conditions, may allow for greater flexibility in drilling operations.

Although the foregoing description contains many specifics, these are not to be construed as limiting the scope of the present invention, but merely as providing certain example embodiments. Similarly, other embodiments of the invention may be devised, which do not depart from the spirit or scope of the present invention. The scope of the invention is, therefore, indicated and limited only by the appended claims and their legal equivalents, rather than by the foregoing description. All additions, deletions, and modifications to the invention, as disclosed herein, which fall within the meaning and scope of the claims are encompassed by the present invention.

What is claimed is:

1. A drilling assembly comprising:

a motor having an outer housing and a drive shaft, the outer housing of the motor configured to be coupled to a drill string and to rotate in a first rotational direction about a longitudinal axis of the drill string to be connected to the motor in unison with rotation of the drill string about the longitudinal axis, the motor configured to rotate the drive shaft in a second rotational direction opposite the first rotational direction about the longitudinal axis of the drill string;

a drill bit for drilling a wellbore, the drill bit coupled to the drive shaft of the motor and configured for drilling responsive to rotation in the second rotational direction about the longitudinal axis of the drill string; and a reamer apparatus coupled to the outer housing of the motor, the reamer apparatus configured for reaming responsive to rotation in the first rotational direction about the longitudinal axis of the drill string in unison with at least a portion of the drill string to enlarge a diameter of the wellbore drilled by the drill bit, at least a portion of the reamer apparatus extending longitudinally relative to the wellbore radially adjacent at least a distal end portion of the drill bit, a distal end of the drill bit and a distal end of the reamer apparatus being at least substantially located in the same plane, the reamer apparatus extending around an outer diameter of the drill bit and within the outer diameter of the drill bit.

2. The drilling assembly of claim 1, wherein the drill bit is at least substantially laterally surrounded by the reamer apparatus.

3. The drilling assembly of claim 1, wherein the motor is at least partially disposed within the reamer apparatus.

4. The drilling assembly of claim 3, wherein the reamer apparatus comprises a substantially tubular shape laterally surrounding at least a portion of the drill bit.

5. The drilling assembly of claim 1, further comprising selectively laterally moveable pads coupled to the drilling assembly and configured to orient the drill string relative to a wellbore.

6. The drilling assembly of claim 1, wherein the outer housing of the motor comprises a threaded portion configured to matingly engage a threaded portion of the reamer apparatus.

7. The drilling assembly of claim 6, wherein the reamer apparatus comprises a proximal end having a substantially annular shape and a plurality of blades, each blade of the plurality of blades extending longitudinally from the annular shape radially adjacent at least a portion of the drill bit.

8. The drilling assembly of claim 7, wherein at least one blade of the plurality of blades extends longitudinally along at least a portion of a distal end portion of the drill bit.

9. The drilling assembly of claim 1, wherein the reamer apparatus is coupled to the distal end of the motor.

10. The drilling assembly of claim 1, wherein the reamer apparatus comprises at least one fluid port configured to direct drilling fluid onto at least a portion of the drill bit.

11. A method of drilling a wellbore in a subterranean formation, comprising:

coupling a drilling assembly to a drill string;

selecting the drilling assembly to comprise:

a motor having an outer housing and a drive shaft, the outer housing of the motor coupled to the drill string and configured to rotate in a first rotational direction about a longitudinal axis of the drill string in unison with rotation of the drill string about the longitudinal axis, the motor configured to rotate the drive shaft in a second rotational direction opposite the first rotational direction about the longitudinal axis of the drill string;

an earth-boring rotary drill bit for drilling a wellbore, the drill bit coupled to the drive shaft of the motor and configured for drilling responsive to rotation in the second rotational direction about the longitudinal axis of the drill string; and a reamer apparatus coupled to the outer housing of the motor, the reamer apparatus configured for reaming responsive to rotation in the first rotational direction about the longitudinal axis of the drill string in unison with at least a portion of the drill string to enlarge a diameter of the wellbore drilled by the drill bit, at least a portion of the reamer apparatus extending longitudinally relative to the wellbore radially adjacent at least a distal end portion of the drill bit, a distal end of the drill bit and a distal end of the reamer apparatus being at least substantially located in the same plane, the reamer apparatus extending around an outer diameter of the drill bit and within the outer diameter of the drill bit;

rotating the earth-boring rotary drill bit within the wellbore in the second rotational direction about the longitudinal axis of the drill string;

rotating the reamer apparatus in unison with at least a portion of the drill string about at least a portion of the drill bit in the first rotational direction opposite the second rotational direction to ream the wellbore.

12. The method of claim 11, wherein rotating the earth-boring rotary drill bit within the wellbore in the second rotational direction comprises rotating the earth-boring rotary drill bit within the wellbore in a counter-clockwise direction from a perspective looking down the wellbore at a first angular velocity; and wherein rotating the reamer apparatus in the first rotational direction comprises rotating the reamer apparatus in a clockwise direction from the perspective looking down the wellbore at a second angular velocity less than first angular velocity.

13. The method of claim 12, further comprising selecting the first angular velocity and the second angular velocity to provide a predetermined amount of torque on the drill string.

14. The method of claim 11, further comprising directing drilling fluid out from at least one port in the reamer apparatus directly onto the drill bit.

15. A method of forming a drilling assembly, comprising:

configuring a drill bit to drill a wellbore in a subterranean formation when rotating in a counter-clockwise direction from a perspective looking down the wellbore;

configuring a downhole motor to rotate a drive shaft thereof in a counter-clockwise direction from the perspective looking down the wellbore when drilling fluid is pumped through the motor;

attaching the drill bit to the drive shaft of the downhole motor;

configuring a reamer apparatus to ream the wellbore within the subterranean formation when rotating in a clockwise direction from the perspective looking down the wellbore;

removably attaching the reamer apparatus to an outer housing of the downhole motor; and configuring the drill bit and the reamer apparatus such that at least a portion of the reamer apparatus extends longitudinally relative to the wellbore radially adjacent at least a distal end portion of the drill bit, a distal end of the drill bit and a distal end of the reamer apparatus are at least substantially located in the same plane, and the reamer apparatus extends around an outer diameter of the drill bit and within the outer diameter of the drill bit.

16. The method of claim 15, further comprising at least substantially surrounding the drill bit with the reamer apparatus.

17. The method of claim 15, wherein removably attaching the reamer apparatus to the outer housing of the downhole motor comprises threading the reamer apparatus to a distal end of the outer housing of the downhole motor.

18. The method of claim 15, wherein removably attaching the reamer apparatus to the outer housing of the downhole motor comprises inserting at least a portion of the outer housing of the motor into the reamer apparatus.

19. The method of claim 15, further comprising configuring a second downhole motor to rotate the reamer apparatus in the clockwise direction from the perspective looking down the wellbore.

20. A drilling assembly comprising:

a reamer apparatus configured for coupling to a drill string and configured for reaming responsive to rotation in a first rotational direction about a longitudinal axis of the drill string in unison with at least a portion of the drill string;

a motor having an outer housing and a drive shaft, the outer housing of the motor at least partially disposed within the reamer apparatus and configured to rotate about the longitudinal axis of the drill string in unison with the reamer apparatus, the motor configured to rotate the drive shaft in a second rotational direction opposite the first rotational direction about the longitudinal axis of the drill string; and a drill bit coupled to the drive shaft of the motor and configured for drilling responsive to rotation in the second rotational direction about the longitudinal axis of the drill string;

wherein at least a portion of the reamer apparatus extends longitudinally radially adjacent at least a distal end portion of the drill bit, a distal end of the drill bit and a distal end of the reamer apparatus are at least substantially located in the same plane, and the reamer apparatus extends around an outer diameter of the drill bit and within the outer diameter of the drill bit.

21. The drilling assembly of claim 20, wherein the reamer apparatus comprises at least one reamer blade configured to move relative to an outside body of the reamer apparatus between a retracted and an expanded position.

* * * * *